United States Patent [19]

Roberts

[11] Patent Number: 4,681,223

[45] Date of Patent: Jul. 21, 1987

[54] KNIFE BLADE PACKAGE AND CONTAINER THEREFOR

[75] Inventor: C. Kenard Roberts, Clinton, Conn.

[73] Assignee: The Stanley Works, New Britain, Conn.

[21] Appl. No.: 825,905

[22] Filed: Feb. 4, 1986

[51] Int. Cl.[4] ..... A45C 11/26

[52] U.S. Cl. ..... 206/354; 206/470; 206/1.5; 206/564; 220/339; 220/356

[58] Field of Search ..... 206/470, 382, 354, 564, 206/1.5; 220/339, 356

[56] References Cited

U.S. PATENT DOCUMENTS

| | | | |
|---|---|---|---|
| 601,568 | 3/1898 | Jacoby . | |
| 2,408,222 | 3/1944 | Muros . | |
| 2,472,582 | 5/1946 | Green . | |
| 2,844,244 | 7/1958 | Hanson . | |
| 2,852,054 | 11/1956 | Motley . | |
| 3,043,354 | 7/1960 | Fitzgerald . | |
| 3,082,903 | 11/1960 | Stevens et al. . | |
| 3,148,103 | 7/1957 | Gallagher . | |
| 3,186,574 | 12/1962 | Davidson . | |
| 3,339,781 | 3/1965 | Schurman et al. . | |
| 3,463,309 | 8/1969 | Szoster | 206/470 |
| 3,489,265 | 5/1967 | Puente . | |
| 3,511,433 | 3/1968 | Andrews et al. . | |
| 3,576,271 | 4/1971 | Seeley . | |
| 3,645,384 | 2/1972 | Wind . | |
| 3,954,179 | 5/1976 | Warmath . | |
| 4,016,972 | 4/1977 | Szamborski | 206/470 |
| 4,169,531 | 10/1979 | Wood . | |
| 4,183,446 | 1/1980 | Davis . | |
| 4,216,862 | 8/1980 | Daenen . | |
| 4,234,084 | 11/1980 | Hutten . | |
| 4,499,353 | 2/1985 | Shields | 206/470 |
| 4,574,951 | 3/1986 | Weaver | 206/470 |

*Primary Examiner*—Joseph Man-Fu Moy

[57] ABSTRACT

A self-hinging one-piece container of synthetic plastic material includes a base element with a peripheral flange and a pedestal portion providing an upwardly opening recess to receive a multiplicity of articles. The base wall of the element portions defining the recess is located in substantially the same plane as the peripheral flange. A cover element includes a peripheral flange overlying the peripheral flange of the base element and a pedestal portion which overlies the pedestal portion of the base element. The top wall of the pedestal portion overlies the top wall of the pedestal portion of the base element and has a depending boss which extends into the recess formed in the base element. Along adjacent margins of the flanges of the base and cover elements is a hinge element integrally formed from the material, and the container additionally includs a releasable closure to retain the cover and base elements in closed relationship.

7 Claims, 5 Drawing Figures

KNIFE BLADE PACKAGE AND CONTAINER THEREFOR

BACKGROUND OF THE INVENTION

The present invention relates to display containers and, more particularly, to display containers for point of purchase packaging which may be used by the purchaser for the continuing storage of articles contained therein, such as the knife blades used in utility knives and the like.

Point of purchase packaging with transparent elements is widely employed to display the articles being merchandised. There has been an increasing tendency to provide packaging which may be used subsequently by the purchaser to store the articles being purchased when such articles either have long life or comprise a multiplicity of expendable items that will be utilized and withdrawn from the container from time to time. In some instances, the packaging employs a blister or other transparent container which is mounted upon a display card imprinted with descriptive and other information. This transparent container is removed from the card for use by the customer.

It has long been known that thermoplastic sheet material may be thermoformed to provide inexpensive transparent packages, and some such packages have used the inherent nature of the plastic sheet material to provide self-hinging of the joined elements providing the two components of the container.

It is an object of the present invention to provide a novel one-piece container for a multiplicity of articles such as knife blades and the like which may be readily and inexpensively formed from synthetic plastic sheet material to provide relatively durable and secure containment.

It is also an object to provide a container which comprises two hinged halves which may be releasably interlocked to provide secure retention of the articles stored therewithin.

Another object is to provide such a container which includes an element to retain articles within a storage recess in which they are placed even though the container may be inverted.

SUMMARY OF THE INVENTION

It has now been found that the foregoing and related objects may be readily attained in a self-hinging one-piece container integrally formed from synthetic plastic material and the container has a base element with a peripheral flange and a pedestal portion including a peripheral wall extending upwardly from the flange and spaced inwardly from its side margins, a support wall extending transversely across the upper end of the peripheral wall and an article-receiving recess in the support wall spaced inwardly from the peripheral wall and extending over the greater portion of the area thereof. The recess is defined by a base wall extending substantially in the plane of the flange and a sidewall extending between the base wall and the peripheral portion of the support wall which lies in the plane of the upper end of the peripheral wall.

The container also has a cover element with a peripheral flange overlying the peripheral flange of the base element and a pedestal portion overlying the pedestal portion of the base element. The cover element pedestal portion includes a preipheral wall extending upwardly from the flange and inwardly from its margins along the outer surface of the peripheral wall of the base element, a top wall extending transversely of the upper end of the peripheral wall of the cover element and overlying the support wall of the base element, and a depending boss spaced inwardly from the peripheral margins of the top wall and extending below the plane of the support wall and into the recess. A hinge element extends between adjacent margins of the flanges of the base and cover elements to provide a self-hinging connection therebetween, and releasable engagement means is provided on the cover and base elements.

Preferably, the container is of elongated, generally rectangular configuration with the hinge element extending along the margins of the flanges along one of the elongated sides, and the interlocking means is disposed along the flange on the other elongated side. Desirably, the flanges of the base and cover elements have cutouts along one side thereof extending from opposed ends to define oppositely extending finger portions which may be deflected to engage the finger portion of the cover element below the finger portion of the base element. The peripheral walls of the base and cover elements are inclined inwardly to define a reduced area at the upper end thereof and each includes a step inwardly along one side thereof providing abutting shoulders.

In the display package, a multiplicity of blades are disposed in the recess of the base element and the boss of the cover element maintains them therewithin.

BRIEF DESCRIPTION OF THE ATTACHED DRAWINGS

DETAILED DESCRIPTION OF THE ILLUSTRATED EMBODIMENT

Figure 1:
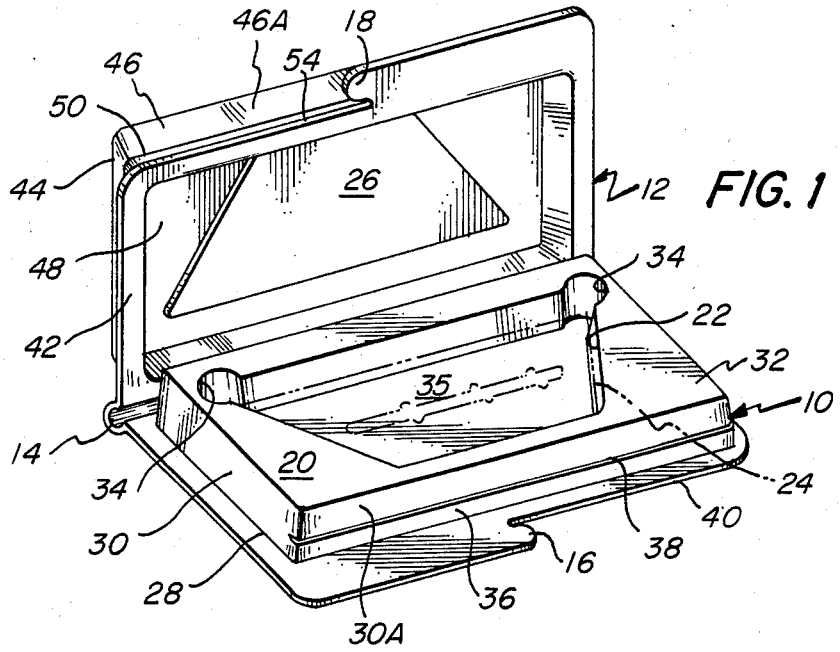
FIG. 1 is a perspective view of a container embodying the present invention with the cover element shown in an opened position and with blades shown in phantom line.

Turning in detail first to FIG. 1, a container embodying the present invention is integrally thermoformed from synthetic plastic material to provide a base element generally designated by the numeral 10, a cover element generally designated by the numeral 12, an elongate hinge element 14 of arcuate cross section, and interlocking fingers 16, 18. The base element 10 has a pedestal portion 20 providing a recess 22 in which a multiplicity of knife or like blades 24 are seated, and the cover element 12 has a depending boss 26 which extends into the recess 22.

The base element 10 includes a peipheral flange 28 which extends about the pedestal portion 20 defined by the peripheral wall 30 extending upwardly from the flange 28 at an inward incline to define a reduced area at its upper end. Extending across and in the plane of the upper end of the peripheral wall 30 is the support wall 32. The recess 22 is formed therein and is defined by the depending sidewall 33 and the base wall 35 which is substantially in the plane of the flange 28. The configuration of the recess 22 is generally that of a trapezoid with two arcuate extensions 34 at the corners of the base of the trapezoid.

Figure 2:
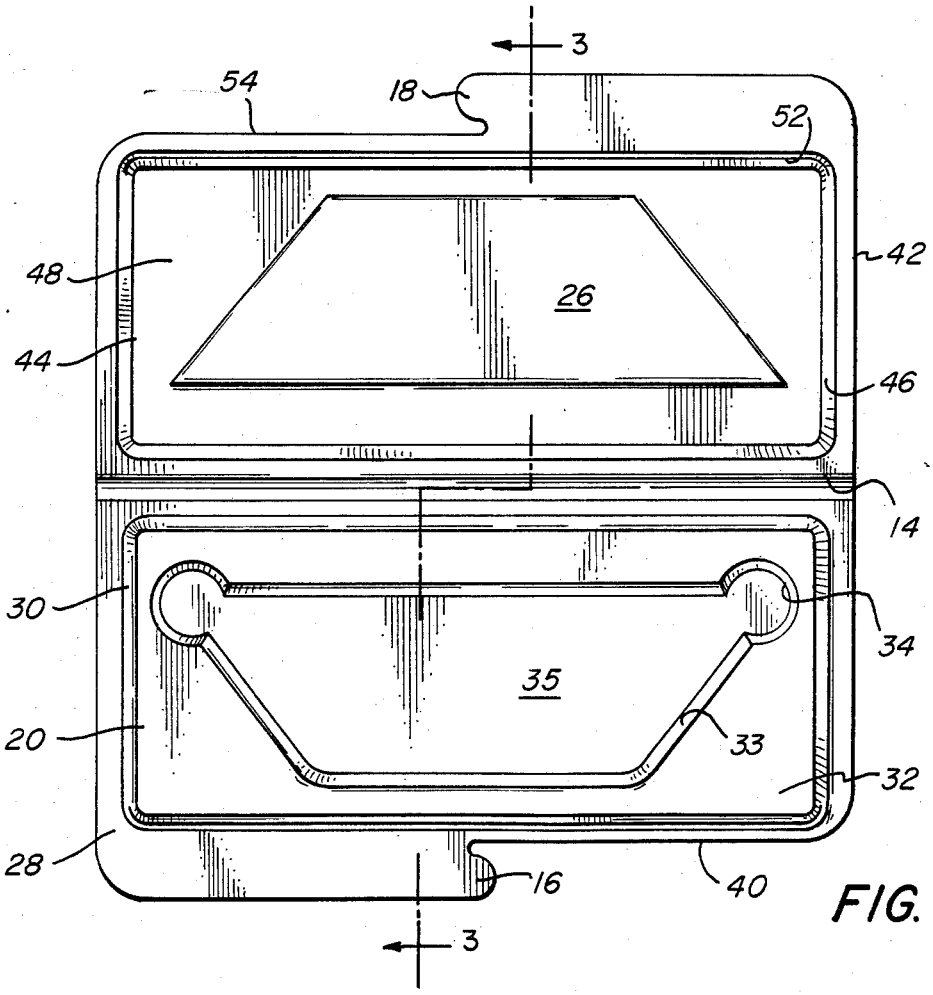
FIG. 2 is a plan view of the fully open container of FIG. 1 and drawn to an enlarged scale.

Extending along the front portion 30*a* of the peripheral wall 30 is a step or rib 36 providing an upwardly facing shoulder 38. The flange 28 is cut out or relieved from the right hand side as seen in FIGS. 1 and 2 to provide an inset 40 and the arcuate finger portion 16 which extends towards the right hand side.

The cover element 12 has a peripheral flange 42 extending thereabout and a pedestal portion 44 which is defined by the peripheral wall 46 which extends upwardly (in the closed position) and is inclined inwardly to define a reduced area at its upper end. Extending across and in the plane of the upper end of the peripheral wall 46 is the top wall 48 in which is formed th depending boss 26. The depression forming the boss 26 is relatively shallow but is of sufficient depth to extend into the recess 22 of the base element 10 when the cover element 12 is closed; its configuration generally conforms to that of the recess 22 and its dimensions are somewhat smaller.

Extending along the front portion 46*a* of the peripheral wall 46 is a step or rib 50 which provides a shoulder 52. The flange 42 is cut or relieved from the left hand side as seen in FIG. 1 and 2 to provide an inset 54 and the arcuate finger 18 which extends towards the left hand side.

Figure 3:
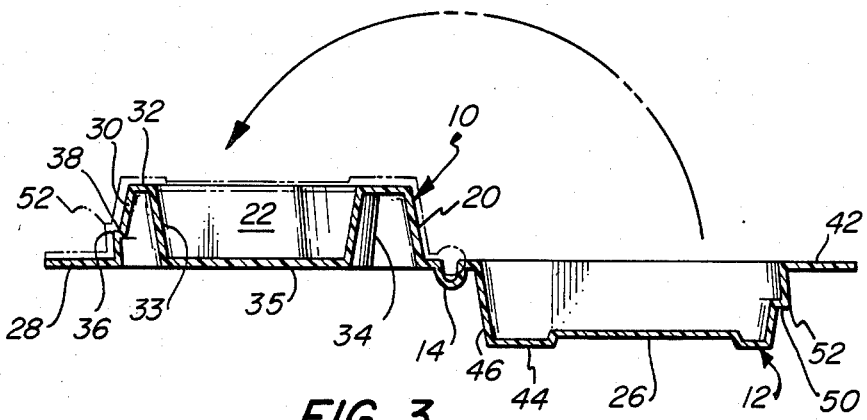
FIG. 3 is a sectional view thereof along the line 3—3 of FIG. 2 and to a scale reduced therefrom, the closed position being shown in phantom line.
Figure 4:
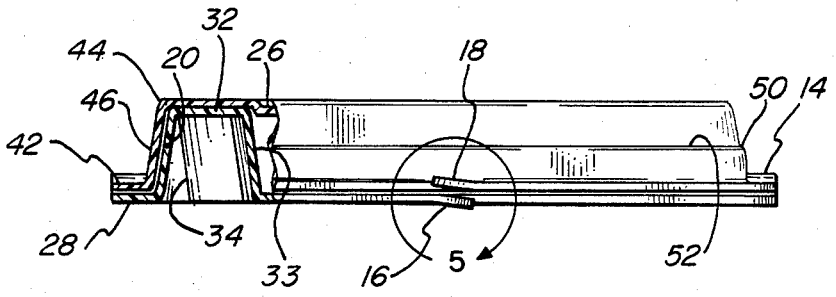
FIG. 4 is a front elevational view in partial section of the closed container before interlocking of the finger.

As seen in FIGS. 3 and 4, the pedestal portions 20 and 44 are cooperatively dimensioned and configured so that the cover element 12 fits snugly over the base element 10 in the closed position with the flanges 28, 42, and with the top wall 48 and support wall 32, in closely overlying relationship. Moreover, the angles of incline of the peripheral walls 30, 46 are essentially the same so that there is a snug fit therebetween, and the steps 36, 50 provide an interference fit.

Figure 5:
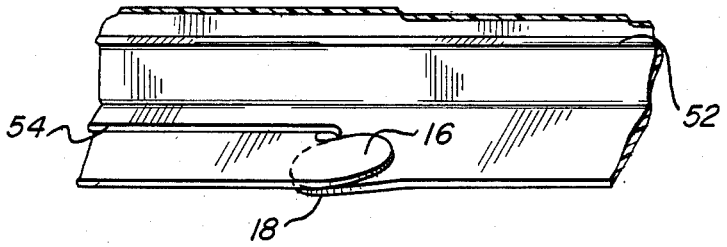
FIG. 5 is a fragmentary enlarged view of the area encircled in FIG. 4 and showing the fingers interlocked.

When the cover element 12 is brought into overfitting relationship to close the container, the fingers 16, 18 are deflected from the position seen in FIG. 4 to dispose the finger 16 above the finger 18, as seen in FIG. 5. In this manner, the cover element 12 is releasably interlocked with the base element 10 to augment the functional engagement.

The boss 26 serves to retain the blades 24 within the recess 22 so that they will not work their way between the support wall 32 and top wall 48. The arcuate recess extensions 34 serve to space and thereby protect the sidewall 33 defining the recess 22 from the ends of the cutting edge of the blades 24.

As will be readily appreciated, the container of the present invention may be readily fabricated from synthetic thermoplastic resin sheet material by conventional thermoforming techniques including vacuum forming and pressure forming. Various thermoplastics providing resilient deformability, reasonable transparency and formability may be employed including polyvinyl chloride, ployethylene, polypropylene, ethylene/-propylene copolymers and impact polystyrene. Polyvinyl chloride has been found advantageous in providing a reasonable balance of properties at relatively low cost.

In actual use for point of purchase packaging, the filled container is mounted upon a paperboard display card imprinted with suitable promotional (and instructional) information. It may be secured thereto by adhesive bonding, thermal sealing, and tape or staple tie-downs, or the flanges may be trapped between two plies of the board. After purchase, the customer removes the container for use as the storage container.

Thus, if can be seen that the novel container of the present invention is one which may be readily and inexpensively formed from synthetic plastic sheet material. It comprises two hinged halves which may be releasably interlocked to securely retain the stored articles, and the boss precludes the movement of the stored articles between the opposed surfaces of the closed container.

Having thus described the invention, what is claimed is:

1. A self-hinging one-piece container integrally formed from synthetic plastic material for knife blades and the like and comprising:

(a) a base element having a peripheral flange and a pedestal portion including a peripheral wall extending upwardly from said flange and spaced inwardly from its side margins, a support wall extending transversely across the upper end of said peripheral wall and an article-receiving recess in said support wall spaced inwardly from the peripheral wall and extending over the greater portion of the area thereof, said recess being defined by a base wall extending substantially in the plane of said flange and a sidewall extending between said base wall and the peripheral portion of said support wall lying in the plane of the upper end of said peripheral wall, said recess being configured and dimensioned to seat snugly a multiplicity of knife blades or the like; (b) a cover element including a peripheral flange overlying said peripheral flange of said base element and a pedestal portion overlying said pedestal portion of said base element, said cover element pedestal portion including a peripheral wall extending upwardly from said flange and inwardly from its margins along the outer surface of said peripheral wall of said base element, a top wall extending transversely of the upper end of said peripheral wall of said cover element and overlying said support wall of said base element, and a depending boss spaced inwardly from the peripheral margins of said top wall and extending below the plane of said support wall and into said recess to retain the knife blades and the like stored within the confines of said recess;

(c) a hinge element extending between adjacent margins of said flanges of said base and cover elements to provide a self-hinging connection therebetween; and (d) releasable engagement means on said cover and base elements, said container being of elongated, generally rectangular configuration with said hinge element extending along the margins of said flanges along one of the elongated sides, said releasable engagement means being disposed along the flange on the other elongated side, said releasable engagement means including resiliently deflectable overlying finger portions on said flanges deflectable to engage the finger portion of said cover element below said finger portions of said base element.

2. The container in accordance with claim 1 wherein said flanges of said base and cover elements have cutouts along one side thereof extending from opposed ends to define oppositely extending finger portions.

3. The container in accordance with claim 1 wherein said peripheral walls of said base and cover elements are inclined inwardly to define a reduced area at the upper end thereof and each includes a step inwardly along one side thereof providing abutting shoulders.

4. A self-hinging one-piece container integrally thermoformed from synthetic plastic sheet material for knife blades and the like and comprising:

(a) a base element having a peripheral flange and a pedestal portion including a peripheral wall extending upwardly from said flange and spaced inwardly from its side margins, a support wall extending transversely across the upper end of said peripheral wall and an article-receiving recess in said support wall spaced inwardly from the peripheral wall and extending over the greater portion of the area thereof, said recess being defined by a base wall extending substantially in the plane of said flange and a sidewall extending between said base wall and the peripheral portion of said support wall lying in the plane of the upper end of said peripheral wall, said recess being configured and dimensioned to seat snugly a multiplicity of knife blades or the like;

(b) a cover element including a peripheral flange overlying said peripheral flange of said base element and a pedestal portion overlying said pedestal portion of said base element, said cover element pedestal portion including a peripheral wall extending upwardly from said flange and inwardly from its margins along the outer surface of said peripheral wall of said base element, a top wall extending transversely of the upper end of said peripheral wall of said cover element and overlying said support wall of said base element, and a depending boss spaced inwardly from the peripheral margins of said top wall and extending below the plane of said support wall and into said recess to retain the knife blades and the like stored within the confines of said recess, said peripheral walls of said base and cover elements being inclined inwardly to define a reduced area at the upper end thereof and each including a step inwardly along one side thereof providing abutting shoulders;

(c) a hinge element extending between adjacent margins of said flanges of said base and cover elements to provide a self-hinging connection therebetween; and (d) releasable engagement means on said cover and base elements, said container being of elongated, generally rectangular configuration with said hinge element extending along the margins of said flanges along one of the elongated sides, said releasable engagement means being disposed along the flange on the other elongated side, said releasable engagement means including resiliently deflectable overlying finger portions on said flanges, said flanges of said base and cover elements having cutouts along one side thereof extending from opposed ends having to define said oppositely extending finger portions, said finger portions being deflectable to engage the finger portion of said cover element below said finger portion of said base element.

5. A display package of knife blades comprising:

(a) a self-hinging one-piece container integrally formed from synthetic plastic material and comprising (i) a base element having a peripheral flange and a pedestal portion including a peripheral wall extending upwardly from said flange and spaced inwardly from its side margins, a support wall extending transversely across the upper end of said peripheral wall and an article-receiving recess in said support wall spaced inwardly from the peripheral wall and extending over the greater portion of the area thereof, said recess being defined by a base wall extending substantially in the plane of said flange and a sidewall extending between said base wall and the peripheral portion of said support wall lying in the plane of the upper end of said peripheral wall, (ii) a cover element including a peripheral flange overlying said peripheral flange of said base element and a pedestal portion overlying said pedestal portion of said base element, said cover element pedestal portion including a peripheral wall extending upwardly from said flange and inwardly from its margins along the outer surface of said peripheral wall of said base element, a top wall extending transversely of the upper end of said peripheral wall of said cover element and overlying said support wall of said base element, and a depending boss spaced inwardly from the peripheral margins of said top wall and extending below the plane of said support wall and into said recess; (iii) a hinge element extending between adjacent margins of said flanges of said base and cover elements to provide a self-hinging connection therebetween; and (iv) releasable engagement means on said cover and base elements, said container being of elongated, generally rectangular configuration with said hinge element extending along the margins of said flanges along one of the elongated sides, said releasable engagement means being disposed along the flange on the other elongated side, said releasable engagement means including resiliently deflectable overlying finger portions on said flanges deflectable to engage the finger portion of said cover element below said finger portion of said base element; and (b) a multiplicity of knife blades sungly seated in said recess, said boss extending into said recess to maintain said blades stored within the confines of said recess in the closed position of said container.

6. The package in accordance with claim 5 wherein said peripheral walls of said base and cover elements are inclined inwardly to define a reduced area at the upper end thereof and each includes a step inwardly along one side thereof providing abutting shoulders.

7. A display package of knife blades comprising:

(a) self-hinging one-piece container integrally thermoformed from synthetic plastic sheet material and comprising (i) a base element having a peripheral flange and a pedestal portion including a peripheral wall extending upwardly from said flange and spaced inwardly from its side margins, a support wall extending transversely across the upper end of said peripheral wall and an article-receiving recess in said support wall spaced inwardly from the peripheral wall and extending over the greater portion of the area thereof, said recess being defined by a base wall extending substantially in the plane of said flange and a sidewall extending between said base wall and the peripheral portion of said support wall lying in the plane of the upper end of said peripheral wall; (ii) a cover element including a peripheral flange overlying said peripheral flange of said base element and a pedestal portion overlying said pedestal portion of said base element, said cover element pedestal portion including a peripheral wall extending upwardly from said flange and inwardly from its margins along the outer surface of said peripheral wall of said base element, a top wall extending transversely of the upper end of said peripheral wall of said cover element and overlying said support wall of said base element, and a depending boss spaced inwardly from the periphery margins of said top wall and extending below the plane of said support wall and into said recess, said peripheral walls of said base and cover elements being inclined inwardly to define a reduced area at the upper end thereof and each including a step inwardly along one side thereof providing abutting shoulders; (iii) a hinge element extending between adjacent margins of said flanges of said base and cover elements to provide a self-hinging connection therebetween; (iv) releasable engagement means on said cover and base elements, said container being of elongated, generally rectangular configuration with said hinge element extending along the margins of said flanges along one of the elongated sides, said releasable engagement means being disposed along the flange on the other elongated side, said releasable engagement means including resiliently deflectable overlying finger portions on said flanges, said flanges of said base and cover element having cutouts along one side thereof extending from opposed ends having to define said oppositely extending finger portions, said finger portions being deflectable to engage the finger portion of said cover element below said finger portion of said base element; and (b) a multiplicity of knife blades snugly seated in said recess, said boss extending into said recess to maintain said blades stored within the confines of said recess in the closed position of said container.

* * * * *